US011204211B2

(12) United States Patent
Tabb

(10) Patent No.: US 11,204,211 B2
(45) Date of Patent: Dec. 21, 2021

(54) LIGHTWEIGHT MACHINE GUN RECEIVER AND METHOD OF MANUFACTURING

(71) Applicant: Travis Tabb, Friendswood, TX (US)

(72) Inventor: Travis Tabb, Friendswood, TX (US)

( * ) Notice: Subject to any disclaimer, the term of this patent is extended or adjusted under 35 U.S.C. 154(b) by 0 days.

(21) Appl. No.: 17/106,299

(22) Filed: Nov. 30, 2020

(65) Prior Publication Data

US 2021/0180894 A1 Jun. 17, 2021

Related U.S. Application Data

(60) Provisional application No. 62/948,930, filed on Dec. 17, 2019.

(51) Int. Cl.
*F41A 3/66* (2006.01)

(52) U.S. Cl.
CPC ..... *F41A 3/66* (2013.01)

(58) Field of Classification Search
CPC ..... F41A 3/66
USPC ..... 89/125
See application file for complete search history.

(56) References Cited

U.S. PATENT DOCUMENTS 4,463,654 A * 8/1984 Barnes ..... F41A 19/09 42/74
4,663,876 A * 5/1987 Reaume ..... F41A 13/12 42/69.01
5,195,226 A * 3/1993 Bornancini ..... B21D 53/00 228/173.6
7,937,877 B2 5/2011 Barrett
10,260,828 B2 4/2019 Harrigan et al.
10,415,919 B1 9/2019 Harrigan et al.

FOREIGN PATENT DOCUMENTS

GB 2450420 A * 12/2008 ..... F41A 3/66

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A lightweight machine gun receiver has a frame having opposed left and right shell portions configured to separably connect to each other in a connected condition, when in the connected condition, the frame defining an internal space configured to receive a reciprocating bolt, have a barrel connection facility, and have a trigger connection facility, when in the connected condition, the frame being an elongated body having a left side panel having upper and lower edges and an opposed right side panel having upper and lower edges, each of the left and right shell portions having top and bottom spans extending laterally from the associated side panel toward corresponding opposed top and bottom spans, the top and bottom spans having respective free ends having respective top and bottom span mating facilities configured to mate with each other, and the top and bottom span mating facilities each having a sliding interface.

20 Claims, 5 Drawing Sheets

LIGHTWEIGHT MACHINE GUN RECEIVER AND METHOD OF MANUFACTURING

CROSS-REFERENCE TO RELATED APPLICATION

This application claims the benefit of U.S. Provisional Patent Application No. 62/948,930 filed on Dec. 17, 2019, entitled "LIGHTWEIGHT MACHINE GUN RECEIVER BOX AND METHOD OF MANUFACTURING," which is hereby incorporated by reference in its entirety for all that is taught and disclosed therein.

FIELD OF THE INVENTION

The present invention relates to firearms, and more particularly to a lightweight machine gun receiver that joins opposed shell portions using dovetail joints to eliminate connecting bolts and welding to reduce weight.

BACKGROUND OF THE INVENTION

Belt-fed machine guns have been in use around the world for many years. The M2, M240, and M1919 machine guns, general-purpose machine guns of choice for large standing armies, were constructed from conventional materials such as carbon steel, riveted together using primitive and laborious manufacturing methods. For example, the M240 machine gun's receiver/frame had over 75 individual parts, riveted together by hand. Although these machine guns had significant firepower and other advantages relevant to Cold War-era battle situations, these machine guns had the considerable disadvantage of being extremely heavy and quite long, making them difficult to carry by foot soldiers.

A complete discussion of the problems with conventional machine gun construction approaches is disclosed in U.S. Pat. No. 7,937,877 to Barrett, which is incorporated into this application by reference in its entirety. There are also several prior art references cited in the '877 Patent that disclose the construction of firearms, both toy and real guns, having left and right frames, left and right housings, and/or left and right shells. The left shell and the right shell of the '877 Patent are welded together to join them at the medial plane by an elaborate welding process. All of the references cited in the '877 Patent utilize bolts, rivets, and/or welding for joining a left shell to a right shell during the manufacture of guns, including machine guns.

Therefore, a need exists for a new and improved lightweight machine gun receiver that joins opposed shell portions using dovetail joints to eliminate connecting bolts and welding to reduce weight. In this regard, the various embodiments of the present invention substantially fulfill at least some of these needs. In this respect, the lightweight machine gun receiver according to the present invention substantially departs from the conventional concepts and designs of the prior art, and in doing so provides an apparatus primarily developed for the purpose of joining opposed shell portions using dovetail joints to eliminate connecting bolts and welding to reduce weight.

SUMMARY OF THE INVENTION

The present invention provides an improved lightweight machine gun receiver, and overcomes the above-mentioned disadvantages and drawbacks of the prior art. As such, the general purpose of the present invention, which will be described subsequently in greater detail, is to provide an improved lightweight machine gun receiver that has all the advantages of the prior art mentioned above.

To attain this, the preferred embodiment of the present invention essentially comprises a frame having opposed left and right shell portions, the left and right shell portions configured to separably connect to each other in a connected condition, when in the connected condition, the frame defining an internal space configured to receive a reciprocating bolt, have a barrel connection facility, and have a trigger connection facility, when in the connected condition, the frame being an elongated body having a left side panel having upper and lower edges and an opposed right side panel having upper and lower edges, each of the left and right shell portions having a top span extending laterally from the associated side panel toward a corresponding opposed top span, the top spans having respective free ends having respective top span mating facilities configured to mate with each other, each of the left and right shell portions having a bottom span extending laterally from the associated side panel toward a corresponding opposed bottom span, the bottom spans having respective free ends having respective bottom span mating facilities configured to mate with each other, and the top and bottom span mating facilities each having a sliding interface. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
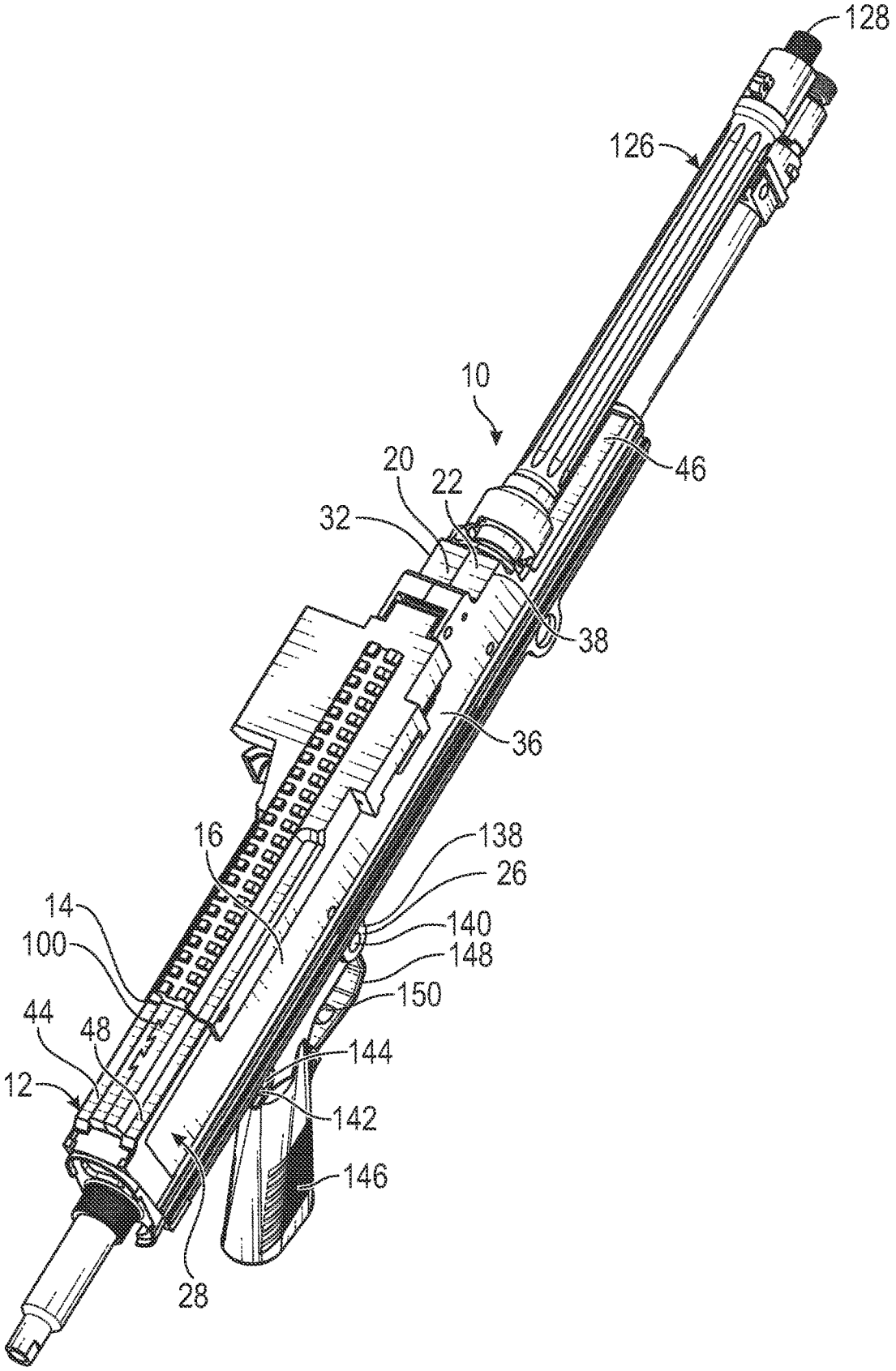
FIG. 1 is a top isometric view of the current embodiment of a lightweight machine gun receiver constructed in accordance with the principles of the present invention.

An embodiment of the lightweight machine gun receiver of the present invention is shown and generally designated by the reference numeral 10.

Figure 2:
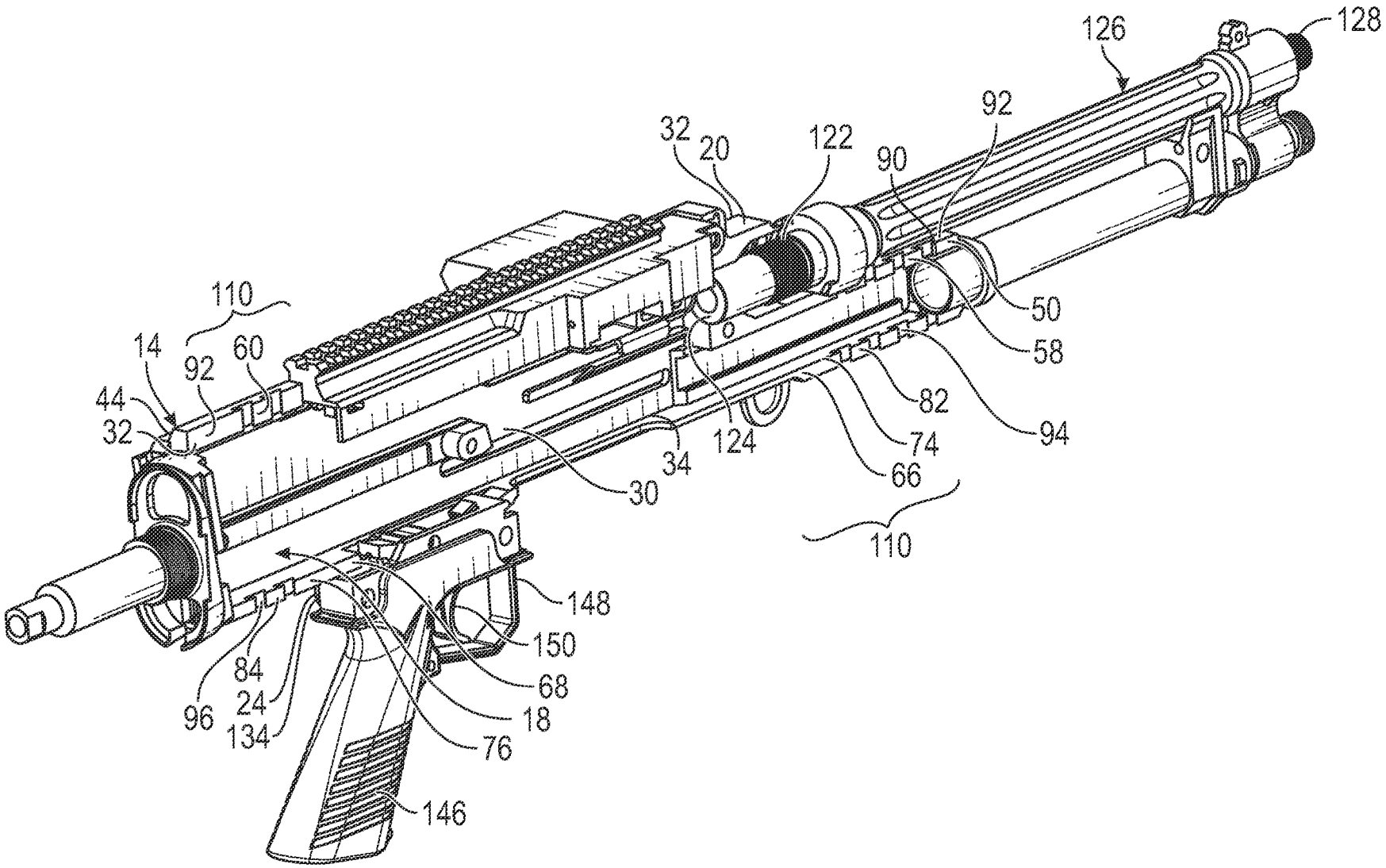
FIG. 2 is a top isometric view of the lightweight machine gun receiver of FIG. 1 with the right shell portion removed.
Figure 3:
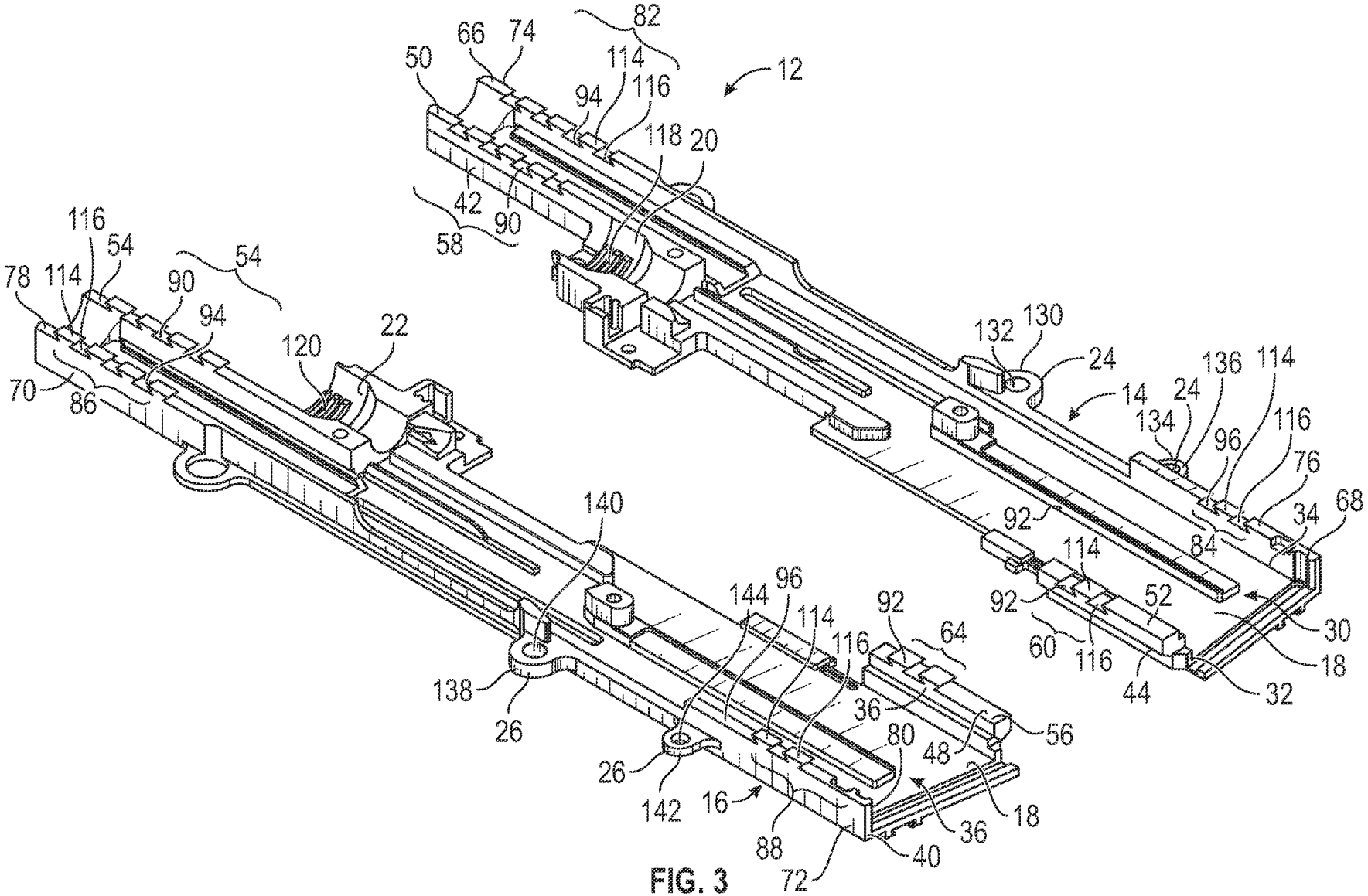
FIG. 3 is an exploded view of the frame of FIG. 1 with the left and right shell portions separated.
Figure 4:
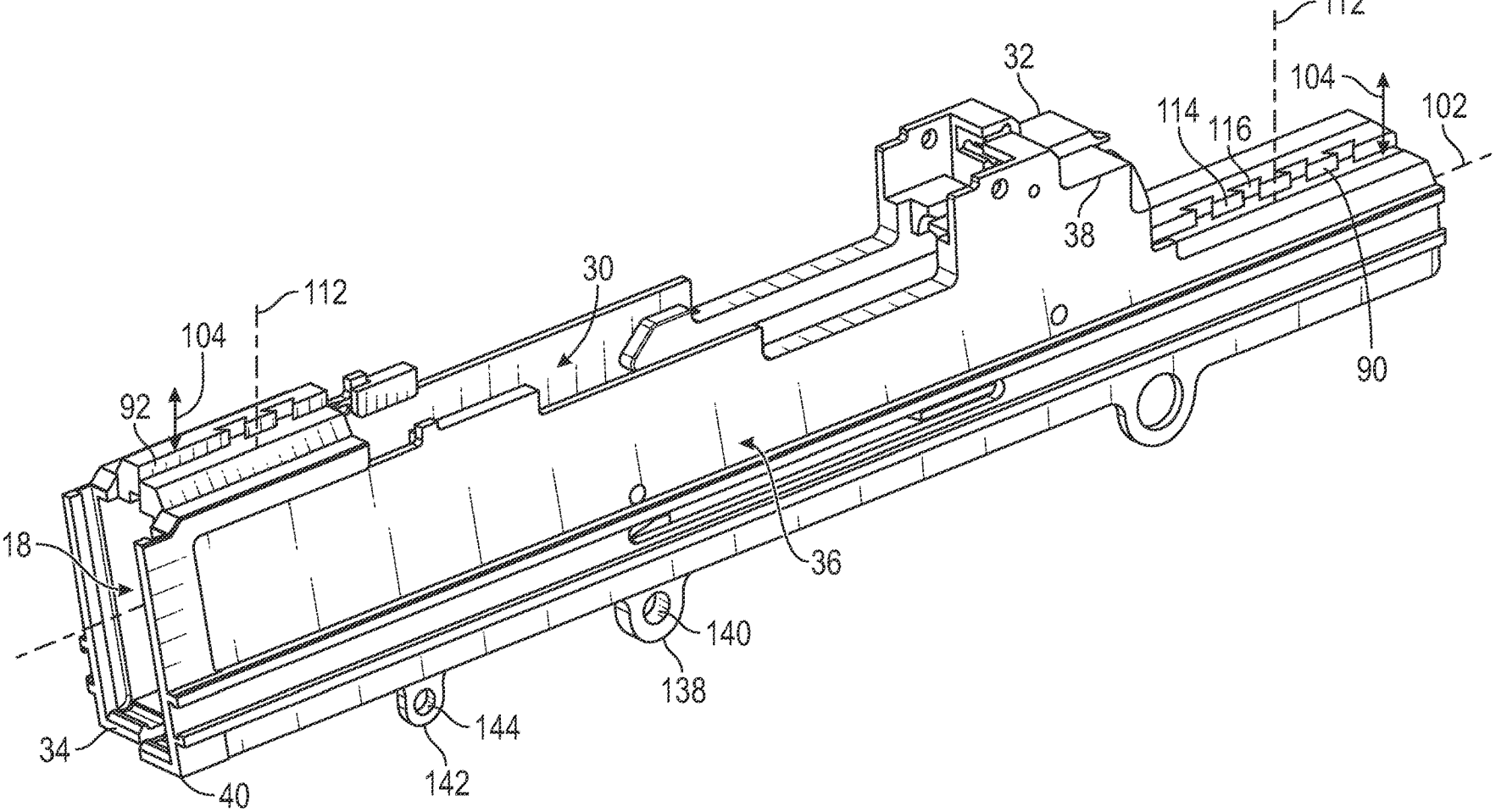
FIG. 4 is a top isometric view of the lightweight machine gun receiver of FIG. 1 showing the left and right shell portions in the process of being assembled into the frame.
Figure 5:
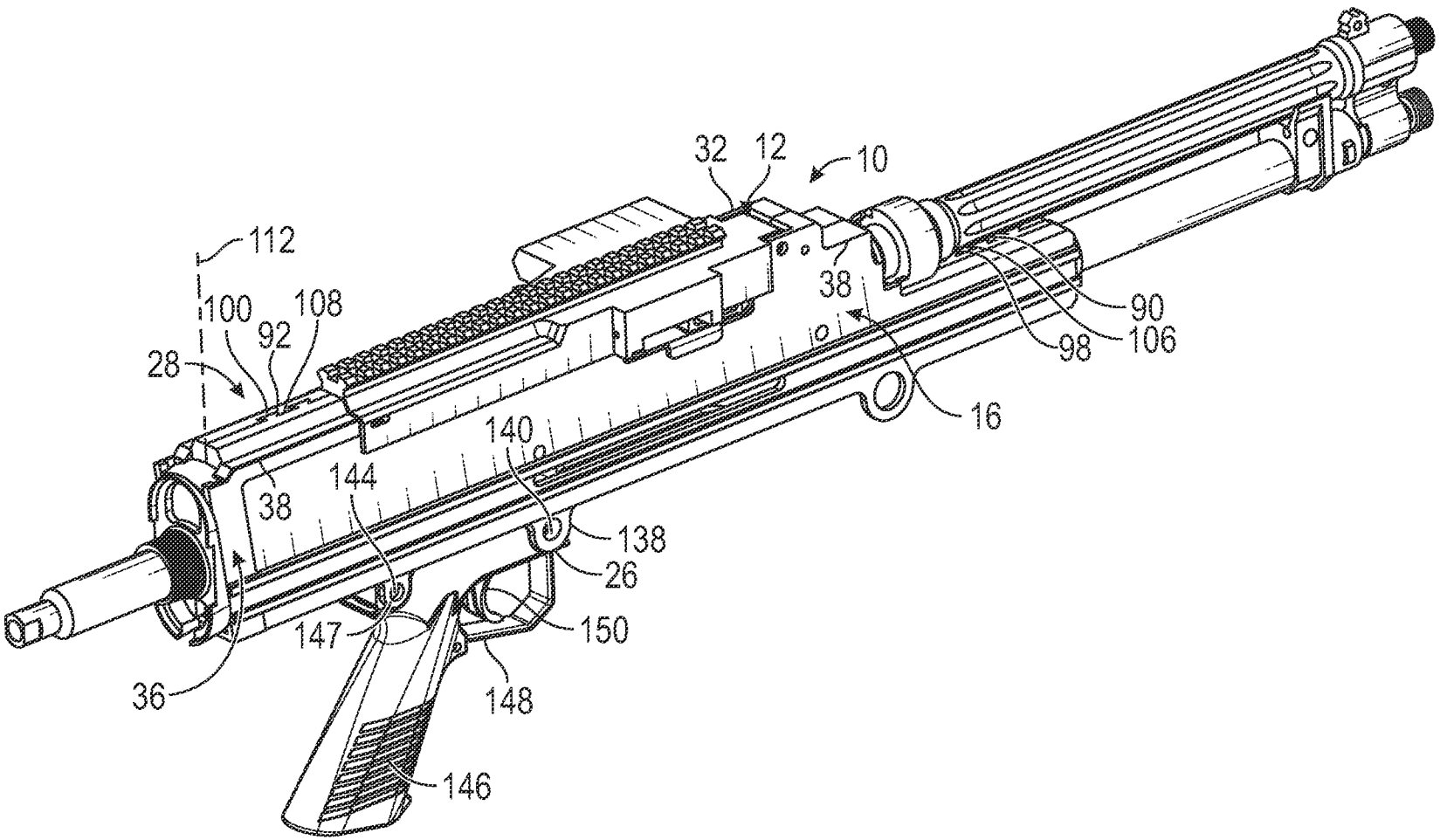
FIG. 5 is a top isometric view of the lightweight machine gun receiver of FIG. 1.

FIGS. 1, 2 & 5 illustrate the improved lightweight machine gun receiver 10 of the present invention, and FIGS. 3 & 4 illustrate the improved lightweight machine gun receiver of the present invention. More particularly, the lightweight machine gun receiver forms part of a belt fed machine gun. The lightweight machine gun receiver has a frame 12 having opposed left and right shell portions 14, 16 that are configured to separably connect to each other in a connected condition shown in FIGS. 1 & 5. When the opposed left and right shell portions are in the connected condition, the frame defines an internal space 18 configured to receive a reciprocating bolt (not shown), have a barrel connection facility (left and right barrel connection facilities 20, 22, and have a trigger connection facility (left and right trigger connection facilities 24, 26). When the opposed left and right shell portions are in the connected condition, the frame is an elongated body 28 having a left side panel 30 having upper and lower edges 32, 34 and an opposed right side panel 36 having upper and lower edges 38, 40. In the current embodiment, the left and right side panels are major planar sidewalls. Each of the left and right shell portions has a top span (left front top span 42, left rear top span 44) extending laterally from the associated side panel toward a corresponding opposed top span (right front top span 46, right rear top span 48), the top spans having respective free ends 50, 52, 54, 56 having respective top span mating facilities (left front top span mating facility 58, left rear top span mating facility 60, right front top span mating facility 62, right rear top span mating facility 64) configured to mate with each other. Each of the left and right shell portions also has a bottom span (left front bottom span 66, left rear bottom span 68) extending laterally from the associated side panel toward a corresponding opposed bottom span (right front bottom span 70, right rear bottom span 72), the bottom spans having respective free ends 74, 76, 78, 80 having respective bottom span mating facilities (left front bottom span mating facility 82, left rear bottom span mating facility 84, right front bottom span mating facility 86, right rear bottom span mating facility 88) configured to mate with each other. The top and bottom span mating facilities each have a sliding interface (top front sliding interface 90, top rear sliding interface 92, bottom front sliding interface 94, bottom rear sliding interface 96) included in the free ends. In the current embodiment, the sliding interfaces are each a dovetail joint (top front and rear dovetail joints 98, 100 are visible in FIG. 5, and there are identical bottom front and rear dovetail joints that are not visible).

The sliding interfaces 90, 92, 94, 96 are operable when connected to prevent relative movement of the left shell portion and the right shell portion except in a single sliding direction. In the current embodiment, the sliding interfaces constrain movement of the opposed left and right shell portions 14, 16 to movement only in a vertical direction with respect to each other. As shown in FIG. 4, the frame 12 and the internal space 18 associated with the left and right shell portions define a frame axis 102, and the sliding interfaces are operable to constrain movement of the opposed left and right shell portions to an interface direction denoted by the double-headed arrows 104 that is perpendicular to the frame axis. The sliding interfaces are also operable to constrain movement of the opposed left and right shell portions to an interface direction that is parallel to the left and right side panels 30, 36, which are major planar sidewalls in the current embodiment. Each of the sliding interfaces includes a junction profile having an articulated shape (top front and rear junction profiles 106, 108 are visible in FIG. 5, and there are identical bottom front and rear junction profiles that are not visible), which in the current embodiment is the zig zag separation pattern of the dovetail joints (top front and rear dovetail joints 98, 100 are visible in FIG. 5, and there are identical bottom front and rear dovetail joints that are not visible). The junction profiles of the top spans are the same as and registered with the junction profiles of the bottom spans. The dashed line parallelograms in FIG. 2 illustrate how the opposed left and right shell portions meet at a medial vertical plane 110. Each of the sliding interfaces includes closely mating cylindrical forms defining a sliding axis 112 (shown in FIG. 4). Each of the sliding interfaces includes a protrusion 114 on one of the opposed left and right shell portions, and a recess 116 on the other of the opposed left and right shell portions adapted to closely receive the protrusion. In the context of the specification, the term "cylindrical" is a form defined by any line swept straight thru space, and includes the protrusions and recesses illustrated that form the dovetail joints.

It should be appreciated that the opposed left and right shell portions 14, 16 are unitary parts that are interconnectable. The left and right barrel connection facilities 20, 22 each include a threaded portion 118, 120 visible in FIG. 3. The threaded portions engage a threaded portion 122 adjacent to the rear 124 of a barrel 126 to secure the barrel to the frame 12 with the muzzle end 128 of the barrel extending forward of the frame. The left trigger connection facility 24 includes a left forward lug 130 having an aperture 132 and a left rearward lug 134 having an aperture 136. The right trigger connection facility 26 includes a right forward lug 138 having an aperture 140 and a right rearward lug 142 having an aperture 144. Pins (not shown) inserted through the apertures connect a grip 146, trigger guard 148, and trigger 150 to the frame. The pins also prevent vertical movement of the opposed left and right shell portions with respect to each other.

By reducing the frame to two parts and fastening them together by dovetail joints, the weight of the resulting lightweight machine gun receiver is greatly reduced compared to conventional approaches employing connecting bolts and welding. The weight is sufficiently reduced that the resulting lightweight machine gun can be safely used by a single individual. Furthermore, not only is the complexity and expense of an elaborate welding process eliminated, but the dovetail joints of the current invention provide a stronger and more rigid connection between the left and right shell portions compared to employing connecting bolts and welding. This makes the frame of the lightweight machine gun receiver more suited to withstand the forces associated with the operation of a belt fed machine gun. Furthermore, the use of single integral sheets of metal that have been precisely machined to produce each of the opposed left and right shell portions reduces the cost and length of the frame compared to conventional approaches to manufacturing a machine gun frame. The interior surfaces of each of the opposed left and right shell portions has a plurality of machined projections at precise locations that, when the left and right shell portions are joined, act as a frame to engage the essential components of a machine gun, including the bolt operating assembly, the trigger assembly, and the barrel assembly. The inside surface of the left shell portion has a similar, but not identical, array of protrusions that function with the operating elements on the right shell inside surface. The inside surface protrusions for left and right shell portions are precision machined for maximum cooperation with the corresponding protruding elements for the essential and proper operation of the machine gun components mounted inside the frame. The frame forms a box capable of receiving all of the necessary essential components of a machine gun, such as a M240 family and MAG58 family of weapons, using existing off-the-shelf components that include the barrel assembly and gas tube attached into the front forward end of the frame. The frame also has a rear vertical section that optionally includes connectors to attach a butt stock plate removably to the frame. The frame is sized and constructed to receive a conventional trigger assembly for a machine gun. The frame includes sized and shaped openings of the proper chamber area to receive mechanisms that provide for the feeding and ejection of ammunition in a high-speed manner.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a lightweight machine gun receiver has been described in detail, it should be apparent that modifications and variations thereto are possible, all of which fall within the true spirit and scope of the invention. Although machine guns have been disclosed, the frame assembled from opposed left and right shell portions and secured by dovetails is also suitable for use with other firearms. Furthermore, any suitable interlocking fit or joint could be used instead of the dovetail joint disclosed. In addition, although the left and right shell portions meeting at a medial vertical plane is disclosed, the left and right shell portions can also meet at a plane offset from vertical to facilitate manufacturing, reduce costs, or for other design reasons. Thus, the sliding direction could be at a variety of angles, including horizontal or rotational, in addition to the vertical sliding direction disclosed. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame having opposed left and right shell portions;

the left and right shell portions configured to separably connect to each other in a connected condition;

when in the connected condition, the frame defining an internal space configured to receive a reciprocating bolt, have a barrel connection facility, and have a trigger connection facility;

when in the connected condition, the frame being an elongated body having a left side panel having upper and lower edges and an opposed right side panel having upper and lower edges;

each of the left and right shell portions having a top span extending laterally from the associated side panel toward a corresponding opposed top span, the top spans having respective free ends having respective top span mating facilities configured to mate with each other;

each of the left and right shell portions having a bottom span extending laterally from the associated side panel toward a corresponding opposed bottom span, the bottom spans having respective free ends having respective bottom span mating facilities configured to mate with each other; and the top and bottom span mating facilities each having a sliding interface.

2. The firearm of claim 1 wherein the sliding interface is a dovetail joint.

3. The firearm of claim 1 wherein the sliding interface is operable to constrain movement of the left and right shell portions to movement only in a vertical direction with respect to each other.

4. The firearm of claim 1 wherein the frame defines a frame axis and wherein the sliding interface is operable to constrain movement of the left and right shell portions to an interface direction perpendicular to the frame axis.

5. The firearm of claim 1 wherein the sliding interface is operable to constrain movement of the left and right shell portions to an interface direction parallel to the left and right side panels.

6. The firearm of claim 1 wherein each of the sliding interfaces includes a junction profile having an articulated shape.

7. The firearm of claim 6 wherein the junction profile of the top spans is the same as and registered with the junction profile of the bottom spans.

8. The firearm of claim 1 wherein the left and right shell portions meet at a medial vertical plane.

9. The firearm of claim 1 wherein each of the sliding interfaces includes closely mating cylindrical forms defining a sliding axis.

10. The firearm of claim 1 wherein each of the sliding interfaces includes a protrusion on one of the left and right shell portions, and a recess on the other of the left and right shell portions adapted to closely receive the protrusion.

11. A firearm comprising:

a frame having opposed interconnectable left and right shell portions that when connected have a barrel connection facility and define a space configured to receive a reciprocating bolt in alignment with the barrel connection facility;

the left shell portion having a left mounting facility;

the right shell portion having a right mounting facility; and the left mounting facility and right mounting facility comprising a sliding interface operable when connected to prevent relative movement of the left shell portion and the right shell portion except in a single sliding direction.

12. The firearm of claim 11 wherein the sliding direction is vertical.

13. The firearm of claim 11 wherein the sliding direction is perpendicular to an axis associated with the space defined by the left and right shell portions.

14. The firearm of claim 11 wherein each of the left and right shell portions includes a major planar sidewall and wherein the sliding direction is parallel to the major planar sidewalls.

15. The firearm of claim 11 wherein the left and right planar sidewalls each includes a span extending laterally from the respective left and right planar sidewalls, and the spans each having free ends including the sliding interface.

16. The firearm of claim 11 wherein the left and right shell portions meet at a medial vertical plane.

17. The firearm of claim 11 wherein the sliding interface is a dovetail joint.

18. The firearm of claim 11 wherein the sliding interface is operable to constrain movement of the left and right shells to movement only in a vertical direction with respect to each other.

19. The firearm of claim 11 wherein the sliding interface includes closely mating cylindrical forms defining a sliding axis.

20. The firearm of claim 11 wherein the sliding interface includes a protrusion on one of the left and right shell portions, and a recess on the other of the left and right shell portions adapted to closely receive the protrusion.

* * * * *